United States Patent [19]

Griffin

[11] 4,048,675

[45] Sept. 20, 1977

[54] JACKET CONSTRUCTION

[75] Inventor: Donald C. Griffin, Englewood, Colo.

[73] Assignee: Plain Brown Wrapper, Inc., Englewood, Colo.

[21] Appl. No.: 648,246

[22] Filed: Jan. 12, 1976

[51] Int. Cl.[2] ..... A41D 1/00

[52] U.S. Cl. ..... 2/93; 2/108; 2/94

[58] Field of Search ..... 2/108, 69, 2, 92, 93, 2/272, 98, 96, 94; 5/343

[56] References Cited

U.S. PATENT DOCUMENTS

| | | | |
|---|---|---|---|
| 2,636,181 | 4/1953 | Becker | 2/243 A |
| 2,878,481 | 3/1959 | Siminow | 2/272 |
| 3,214,770 | 11/1965 | Smith | 2/227 |
| 3,950,789 | 4/1976 | Konz et al. | 2/93 |

*Primary Examiner*—Werner H. Schroeder
*Assistant Examiner*—D. L. Troutman
*Attorney, Agent, or Firm*—Blanchard, Flynn, Thiel, Boutell & Tanis

[57] ABSTRACT

Garment construction for providing a down-filled jacket. There is provided in kit form for home assembly a jacket construction comprising a plurality of separately constructable panels. Each panel includes inner and outer sheets, said sheets being closed along their respective perimeters to form an envelope, the envelope is filled with down through a gate temporarily left therein, the gate then closed and with the down suitably distributed through the envelope, same is quilted. The independent and separate panels are then stitched together by stitching independent of the stitching by which the edges of the envelopes were closed and the whole is assembled into a finished jacket.

12 Claims, 6 Drawing Figures

JACKET CONSTRUCTION

FIELD OF THE INVENTION This invention relates to garment construction and particularly to a down-filled outdoor jacket, such as a ski jacket, particularly adapted for sale in separate components for amateur or home assembly.

BACKGROUND OF THE INVENTION

While down-filled jackets have been known for a long time, their popularity has increased greatly over the last few years by their appearance and acceptance in ski areas and for other outdoor uses. They are, however, expensive and a substantial business has grown up in the preparation and selling of such jackets in kit form for home assembly. Such kits usually consist of appropriate material precut to form a jacket of desired size and style together with down material in appropriate form for insertion into the jacket. These kits have been extremely popular and have received a great deal of attention as continuing efforts have been made to improve the resulting product while at the same time rendering easier the task of assembling and finalizing the components into a completed jacket.

One of the principal problems in this direction has been the problem of inserting the down and then sewing the jacket properly to confine the down to specified locations and prevent it from migrating in an undesirably concentrated manner into certain portions, as the lower portions, of the jacket.

While there are several ways known to the art by which the down may be handled, it results in some cses in very awkward insertion procedures and in other cases in awkward assembly of the jacket components after the down is inserted and confined.

In a continuing effort to improve this type of product and to provide a kit which is readily adaptable to home use, efforts have been made to design a product in which the down can be inserted in a simple manner into an evelope comprising predetermined panels or other components of the jacket, steps then taken for confining the down to predetermined portions of said envelope, and finally, without subsequent disturbance of the down, the components of the jacket can be fastened together quickly and reliably by a seamstress of only limited skill and utilizing nothing more complex than a home sewing machine and utilizing same in a simple manner.

Accordingly, the objects and purposes of the invention include:

1. To provide a kit from which can be assembled in a simple manner a strong, sturdy and attractive down-filled outdoor jacket, such as a ski, or other outdoor, jacket.

2. To provide a kit, as aforesaid, in which the down may be introduced into an envelope comprising a panel or other component of the jacket and may be fixed into position therein prior to the assembly together of such components.

3. To provide a kit for a jacket, as aforesaid, in which said components, after the filling and localizing of the down in the various components thereof, may be assembled together rapidly and easily and by the use of only relatively simple sewing equipment and techniques.

4. To provide a kit for a jacket, as aforesaid, wherein the material for the several panels may be chosen freely to provide a wide variety of color arrangements therein.

5. To provide a kit for a jacket, as aforesaid, which is capable of a wide range of specific design modifications for the presentation of jackets having a wide range of specific design features and characteristics in order to provide jackets having a wide range of possible uses.

Other objects and purposes of the invention will be apparent to persons acquainted with items of this nature upon a reading of the following specification and inspection of the accompanying drawings.

SUMMARY OF THE INVENTION

Briefly, the invention contemplates a jacket or other similar garment comprising a plurality of components such as front panels, a back panel and sleeves, each of which includes a front sheet, a back sheet, down inserted therebetween, and the whole quilted and sewn together. Particularly, each of the components after the down is inserted thereinto is folded inwardly and back along its edges and the edges sewn to close the envelope constituting each component. The down is then fixed in place, as by quilting. The components are next sewn together at their respectively adjacent edges by same being folded inwardly and a further seam placed therethrough, preferably slightly spaced from the seams closing the edges whereby the seam fastening the jacket components together is independent of the seams closing the edges and all combine to make an extremely strong and sturdy product but one which can be easily handled by the simple equipment and techniques normally available to the average home seamstress.

DETAILED DESCRIPTION

Figure 1:
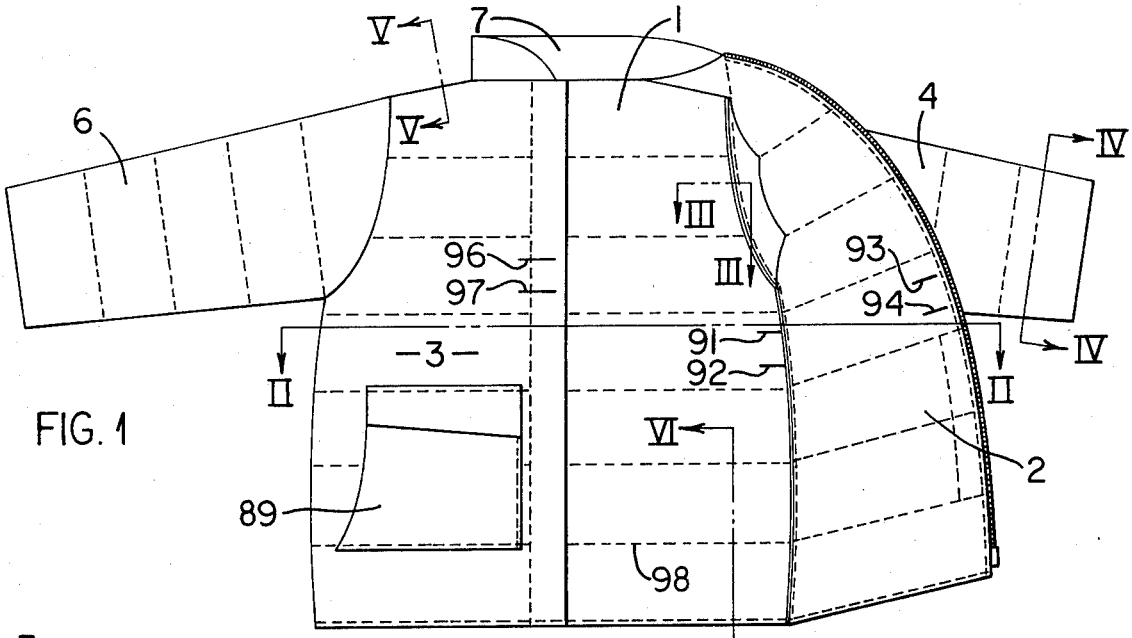
FIG. 1 shows a completed ski jacket embodying the invention viewed from the front thereof with one front panel laid back to expose inside sewing details.

With reference now to the drawings in detail, there is shown in FIG. 1 a jacket, here a ski jacket, haing a back panel 1, a left front panel 2, a right front panel 3, a left sleeve 4, a right sleeve 6 and a collar 7. The precise size and design of these portions may be chosen freely within the scope of the invention and one of the advantages of the invention is its adaptability to a wide range of such specific designs.

Figure 2:
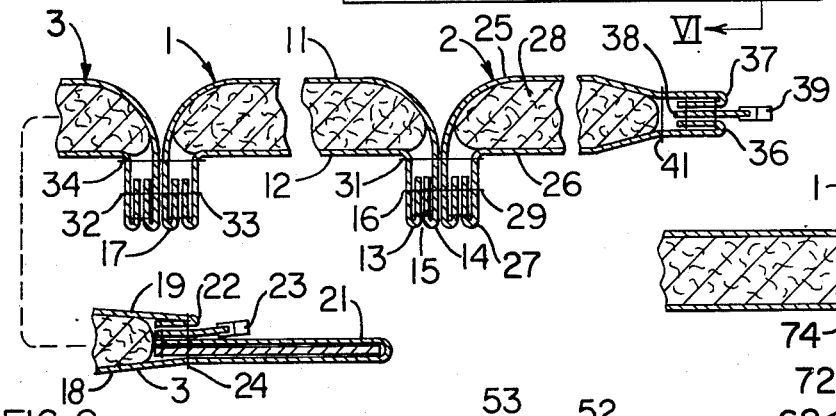
FIG. 2 is a somewhat schematicized broken view taken on the line II—II of FIG. 1 but showing only the back portion thereof and omitting that part of the right front panel indicated in FIG. 1 as being cut by said cutting line.

Looking first at the back panel, there is shown (FIG. 2) an outer sheet 11 and an inner sheet 12, the two being superposed on each other and down provided therebetween. The edges of said sheets 11 and 12 are turned back on each other at 13 and 14, respectively, and stitched at 16 to fix same in position. A similar finishing of the opposite edge is provided at 17 where the rightward (leftward as appearing in the drawing) edge of the back panel 1 is connected to the rightward (leftward as appearing in the drawing) edge of the front panel 3.

The front rightward panel 3 comprises an outer sheet 18 and an inner sheet 19 with down therebetween, the outer sheet being bent back on itself as indicated at 21 and the inner sheet 19 being bent back upon itself as indicated at 22 and the two stitched together and to the fastening tape of one side 23 of a zipper by the stitching 24.

The leftward front panel 2 similarly comprises an outer sheet 25 and an inner sheet 26 with down 28 located therebetween. At the edge 27 of said panel 2 the sheets 25 and 26 are folded back upon each other in the same maner as above described in connection with the adjacent edge of the panel 1 and stitched in position by the stitching 29. The two edges 15 and 27 are then both turned inwardly of the jacket and stitched at 31 which in this case is a single row of stitching but can be multiple if desired. The important feature, however, is that the stitching 31 passes through all four sheets of the two panels 1 and 2, namely the sheets 11 and 12 of panel 1 and the sheets 25 and 26 of panel 2 while the separate stitchings 16 and 29 independently fasten the turned-back edges of said respective four sheets. Thus, the stitching which holds the turned-back edges of said sheets is not dependent upon or affected by the stitching holding said panels together and vice versa.

The adjacent edges of the panels 1 and 3 are turned back on themselves and stitched together by stitching 32 and 33 in the same manner as above described in connection with the stitching 16 and 29 and said edges are then turned together and fastened by the stitching 34 extending through all four sheets of the panels 1 and 3, namely the sheets 11 and 12 of panel 1 and the sheets 18 and 19 of panel 3.

The free edge of panel 2 comprises turned-back edges at 36 and 37 of panels 26 and 27, respectively, with the fastening tape 38 of the other side of the zipper inserted therebetween and the whole fixed by single or multiple stitching as desired, here indicated as a single stitching 41.

Figure 4:
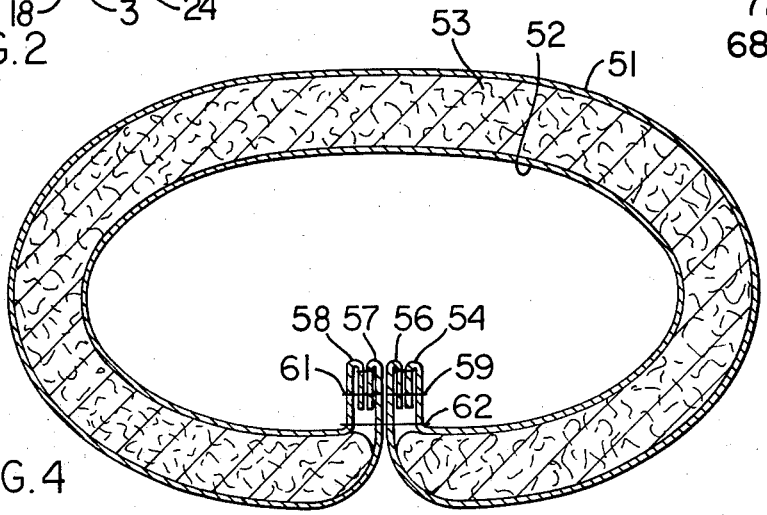
FIG. 4 is a somewhat schematicized section taken on the line IV—IV of FIG. 1.

The sleeve is formed in the same general manner and with the same type of stitching as shown above for the front and back panels and as illustrated in FIG. 4. Here an outer sheet 51 is positioned in register with an inner sheet 52, with down 53 filled therebetween. The edges of said sheets are turned back on each other at 54 and 56 for the one edge and 57 and 58 for the other edge with said turned-back portions being stitched at 59 and 61 to hold same in position. Such two edges are then turned adjacent each other (with the sleeve inside out) and stitched together by a single or multiple row of stitching here indicated as a single row 62 extending through all four layers comprising material adjacent the respective two sides of the inner and outer sheets 51 and 52.

Figure 3:
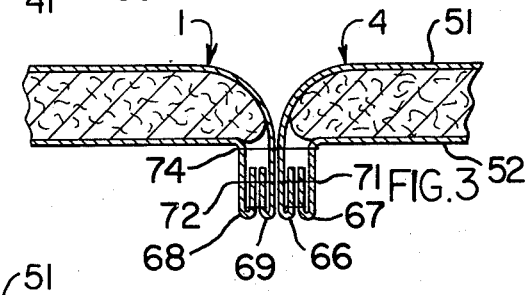
FIG. 3 is a somewhat schematicized section taken on the line III—III of FIG. 1.

The sleeve is then fixed into the front and rear panels of the jacket in an appropriate sleeve hole by the same stitching technique as already described above for associating other edges of the jacket with each other. Specifically (FIG. 3), the ends of the outer and inner sheets 51 and 52 are turned back at their edges 66 and 67 and the corresponding adjacent edges of the inner and outer sheets of the back panel 1 are likewise turned back on each other at 68 and 69. Same are stitched at 71 and 72 for holding them in such position and the edges themselves of the panel and sleeve are folded inwardly and stitched at 74, such stitching extending all of the way around the sleeve opening.

Figure 5:
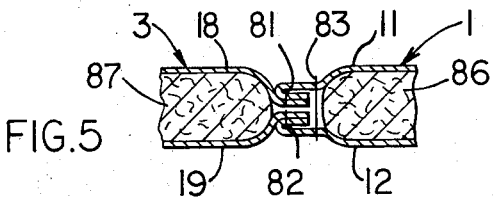
FIG. 5 is a somewhat schematicized section taken on the line V—V of FIG. 1.

The sleeve 6 is made and fixed into an appropriate sleeve hole on the righthand side of the garment in the same maner as already described for the sleeve 4. The shoulder seam between the front and back panels of the jacket may be formed in the same manner as already described for connecting other panels to each other or preferably would be found to be sufficiently strong if formed in a manner to minimize the likelihood of discomfort occurring because of the seam bearing against the wearer's shoulder. This is illustrated in FIG. 5 and consists of any convenient form of conventional flat seam which is preferably made while the panels are in unassembled condition and only subsequently stitched in connection with the providing of compartments for holding of the down. In the specific form shown, the outer sheet 18 of the front rightward panel 3 and the outer sheet 11 of the back panel 1 are both turned inwardly and stitched at 81. The inner sheets 19 and 12, respectively, are similarly turned inwardly and stitched at 82. The whole is then subsequently stitched at 83 to define compartments 86 and 87 for the reception and confining of down as hereinafter more fully described.

Figure 6:
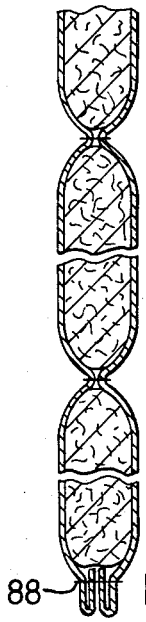
FIG. 6 is a somewhat schematicized section taken on the line VI—VI of FIG. 1.

The collar may be provided in any desired manner and the free edges of the jacket, namely the bottom edge of the panels 1, 2 and 3 and the ends of the sleeves may likewise be provided in any desired manner. For example, the bottom edge of the jacket as well as the sleeves may be provided by turning back the edges thereof and stitching as indicated at 88 in FIG. 6.

Pockets may be provided if desired in any conventional manner, one such pocket being indicated at 89.

In assembling the jacket as above described, and referring first to the back panel 1 to illustrate the procedure, the sheets 11 and 12 are laid on top of each other, the edges turned back as indicated at 15 and 17 and the stitching provided as indicated at 16 and 33. Likewise, the bottom edge is stitched together as above described and indicated at 88. The shoulder seams are likewise stitched together as above described. In the edge stitching, however, small gates are left at any desired point such as between the lines 91 and 92 in FIG. 1 for the back panel, corresponding locations such as between lines 93 and 94 for the left front panel and between lines 96 and 97 for the right front panel. Down is introduced into the three panels through these gates after which the gates are stitched closed in the same manner as the stitching for the remainder of said edges. The down is then spread uniformly throughout the panel, and quilting stitches are provided in any desired pattern, such as the parallel lines of quilting stitches 98 shown in the back panel in FIG. 1.

The same procedure is followed for the front panels 2 and 3 and for the sleeves. Upon the completion of the filling with down and quilting, the panels are ready for stitching together in the manner above described.

By thus filling the down into the panels and carrying out the quilting stitching, same can be accomplished with individual panels and without appreciable difficulty. The down is fully captured within the panel and with reasonable care can be maintained properly distributed while the quilting stitching is carried out. With this completed for each of the components of the jacket, said components may then be fastened together by stitching together of their respective edges as above described without disturbing the down or the quilting of said several panels.

This provides a strong and sturdy jacket and one which at no time requires other than moderate sewing ability nor does it require equipment other than an ordinary home-type sewing machine. A wide variety of individual designs may be followed as well as a wide range of types of material may be used.

Although particular preferred embodiments of the invention have been disclosed in detail for illustrative purposes, it will be understood that variations or modifications of the disclosed construction, including the rearrangement of parts, lie within the scope of the present invention.

The embodiments of the invention in which an exclusive property or privilege is claimed are defined as follows:

1. In an outdoor jacket, such as a ski jacekt, of the down-filled type, the combination comprising:

a plurality of panels each comprising superposed inner and outer sheets, the peripheral edge strips of said inner sheet and outer sheet being folded under through substantially 180° to edge each sheet with a U-section, outwardly convex fold, the folded under edge strips of said inner sheet and outer sheet lying sandwiched between said sheets of said panel and face-to-face with each other and forming substantially a UU-shaped cross section edge zone for said panel;

a first stitch line substantially parallel to the panel edge, said first stitch line passing through the two thicknesses defined by said folded under face-to-face edge strips near said folds thereof and closing said panel edges to form a down-proof envelope;

a downlike material within said envelopes and distributed substantially uniformly throughout each of said envelopes;

a second stitch line through the four-sheet thickness of said UU-shaped cross section envelope edge zone and spaced from the panel edge by said first stitch line;

a pair of said panels being fixed together in edge-to-edge relation with the adjacent UU-section edge zones of said panel pair each being turned through about 90° from the plane of their respective panel to extend toward the interior of the jacket, with the outer sheets of said panels abutting in said edge zones and forming an eight thickness, substantially UUUU-cross section panel pair joinder zone;

a third stitch line securing said pair of panels together in said edge-to-edge relation, said third stitch line being spaced close inboard from said UUUU-cross section zone free of contact with said folded under edge strips and passing through only one half the sheet thicknesses of each UUUU-cross section zone, the first, second and third stitch lines each penetrating a different combination of said peripheral edge strips and sheet portions bound thereby.

2. The construction of claim 1, in which said jacket comprises a back panel extending substantially the height and width of the back of the jacket and having substantially upstanding side edges, said jacket further comprising a front panel having an upstanding side edge joined to one of the upstanding side edges of said back panel and defining a said pair of said panels whose panel pair joinder zone, at said side edges, incorporates said UUUU-cross section and first, second and third stitch lines.

3. The construction of claim 2, in which said jacket further includes a sleeve panel rolled into tubular, sleevelike form, said side panel and back panel having opposed edge segments spaced apart to define a sleeve opening therebetween, one edge of said sleeve panel, at the inboard end of said tubular sleeve, being joined to the edge portions of said back panel and front panel forming said sleeve opening and in a said panel pair joinder zone extending fully around sleeve end and opposed sleeve opening to join said sleeve to said jacket with said UUUU-cross section and first, second and third stitch lines.

4. The construction of claim 3, in which said sleeve panel has opposite edges extending longitudinally of said tubular sleeve and joined to each other to circumferentially close said tubular sleeve, said opposed longitudinal sleeve panel edges defining a further said panel pair joinder zone having said UUUU-cross section with said first, second and third stitch lines.

5. The construction of claim 2, in which, at each said panel pair joinder zone, the four folds of said UUUU-cross section are substantially equidistant from said third stitch line.

6. The construction of claim 2, in which the bottom of said front and back jacket panels comprises a said UU-shaped cross section envelope edge zone, with at least one said stitch line stitching together the folded under peripheral edge strips and the adjacent inner and outer sheet portions.

7. The construction of claim 2, in which said jacket has a pair of said front panels provided with relatively opposed side edge portions carrying first and second coacting parts of a zipper extending therealong, said zipper parts each having a fastening tape extending longitudinally thereof, one of said two zipper supporting panel side edges being a said UU-shaped cross section envelope edge zone, but with the corresponding zipper fastening tape interposed between said U's and with at least said first stitch line extending through said fastening tape, the other of said zipper bearing panel side edges having the exterior-most one of its U-shaped section parts extending laterally substantially beyond the corresponding zipper part and being filled by a filler strip, so as to overlie and hide the other zipper bearing edge in the zipped condition of said jacket.

8. The construction of claim 3, in which the jacket includes shoulder seams joining the tops of the front and back panels inboard of the sleeves, wherein a shoulder seam is formed which differs from said side and sleeve seams, said shoulder seam consisting of a UU cross section edge zone on one of said panels, wherein said U's sandwich therebetween the unfolded edge extremities of the inner and outer sheets of the other panel to form a six-thickness seam and including stitch lines symmetrically joining the innermost ones and outermost ones of such thickness.

9. The construction of claim 1, in which said four folds of said UUUU-cross section lie substantially equidistant from said third stitch line, said folded-in edge strips being bound by said first and second stitch lines and the remainder of said inner and outer sheets, adjacent said edge strips, being bound by said second and third stitch lines in a symmetric manner.

10. The construction of claim 1 including also stitching between said sheets for dividing said envelope into a plurality of downretaining compartments.

11. The construction of claim 1 wherein the same type of stitching is used to close all envelopes, thereby to minimize the skill required to assemble same.

12. The construction of claim 1 wherein the same type of stitching is used to connect at least most of the panels to each other, thereby to minimize the skill required to assemble same.

* * * * *